US005550889A

United States Patent [19]

Gard et al.

[11] Patent Number: 5,550,889

[45] Date of Patent: Aug. 27, 1996

[54] ALIGNMENT OF AN X-RAY TUBE FOCAL SPOT USING A DEFLECTION COIL

[75] Inventors: Michael F. Gard, Perry, Okla.; Stephen W. Gravelle, Mequon, Wis.; Jiang Hsieh, Waukesha, Wis.; Quan N. Lu, Milwaukee, Wis.; John W. Newman, Naperville, Ill.; Thomas L. Toth, Brookfield, Wis.; Michael A. Wu, Oro Valley, Ariz.

[73] Assignee: General Electric, Waukesha, Wis.

[21] Appl. No.: 345,082

[22] Filed: Nov. 28, 1994

[51] Int. Cl.[6] ..... H01J 35/30

[52] U.S. Cl. ..... 378/113; 378/121; 378/137

[58] Field of Search ..... 378/113, 115, 378/114, 116, 119, 121, 137, 138, 207

[56] References Cited

U.S. PATENT DOCUMENTS

| | | | |
|---|---|---|---|
| 4,171,476 | 10/1979 | Waltham | 250/445 |
| 4,178,511 | 12/1979 | Hounsfield et al. | 250/445 |
| 4,637,040 | 1/1987 | Sohval et al. | 378/9 |
| 4,827,494 | 5/1989 | Koenigsberg | 378/137 |
| 4,993,055 | 2/1991 | Rand et al. | 378/125 |
| 5,291,535 | 3/1994 | Baker et al. | 378/207 |
| 5,313,510 | 5/1994 | Ebersberger, et al. | 378/12 |

*Primary Examiner*—Don Wong
*Attorney, Agent, or Firm*—Quarles & Brady

[57] ABSTRACT

Precise alignment of the focal spot position on an x-ray CT system is achieved using a deflection coil that produces a magnetic field which acts on the electron beam path in the x-ray tube. A variable current power supply drives the deflection coil and is controlled by input signals to align the focal spot at a static reference position, to correct for focal spot drift between scans, and to wobble the focal spot position during a scan or between scans.

4 Claims, 2 Drawing Sheets

ALIGNMENT OF AN X-RAY TUBE FOCAL SPOT USING A DEFLECTION COIL

BACKGROUND OF THE INVENTION

The present invention relates to x-ray systems, and more particularly, to the alignment of the focal spot in an x-ray tube.

In a contemporary computed tomography system, an x-ray tube projects a fan-shaped beam which lies within the X-Y plane of a Cartesian coordinate system, termed the "imaging plane." The x-ray beam passes through the object being imaged, such as a medical patient, and impinges upon an array of radiation detectors. The intensity of the transmitted radiation is dependent upon the attenuation of the x-ray beam by the object and each detector produces a separate electrical signal that is a measurement of the beam attenuation. Attenuation measurements from all detectors are acquired separately to produce the transmission profile.

The tube and detector array in a conventional CT system are rotated on a gantry within the imaging plane and around the object so that the angle at which the x-ray beam intersects the object constantly changes. The set of x-ray attenuation measurements from the detector array at a given angle is referred to as a "view"; and a "scan" of the object is comprised of a set of views made at different angular orientations during one revolution of the x-ray source and detector. In a 2D scan, data is processed to construct an image representative of a two dimensional slice taken through the object. The prevailing method for reconstructing an image from 2D data is referred to in the art as the filtered backprojection technique. This process converts the attenuation measurements from a scan into integers called "CT numbers" or "Hounsfield units", which are used to control the brightness of a corresponding pixel on a cathode ray tube display.

The image reconstruction process relies on a very accurately positioned focal spot from which the fan-shaped x-ray beam emanates. The focal spot is the location on the x-ray tube anode which is struck by an electron beam emanating from a cathode. Misalignment of this focal spot by as little as 0.025 mm can result in sampling errors that reduce image resolution and produce image artifacts.

Perfect mechanical alignment of the x-ray tube focal spot is difficult to achieve in a commercial production setting and difficult to maintain in a clinical setting. Calibration and alignment procedures are used to position the x-ray tube focal spot during initial manufacture and during tube replacement in the field. These procedures are delicate and time consuming. In addition, such static focal spot alignment does not account for small displacements that can occur during the operation of the scanner due to thermally-related dimensional changes in the x-ray tube structures.

SUMMARY OF THE INVENTION

The present invention relates to an improved x-ray source in which a deflection coil is mounted adjacent to the electron beam path in an x-ray tube, and the magnetic field produced by current flow in the deflection coil precisely controls the focal spot location on the x-ray tube anode. More particularly, the present invention includes a deflection coil mounted adjacent to the electron beam path in an x-ray tube for producing a magnetic field that is substantially uniform and substantially perpendicular to the electron beam path; a variable current power supply connected to produce a current in the deflection coil in response to the magnitude of an input signal; and a signal generator or other control apparatus that produces an input signal for the variable current power supply that aligns the focal spot in a predetermined location.

A general object of the invention is to magnetically align the x-ray tube focal spot. During system calibration an input signal or commend is determined which will precisely align the focal spot for accurate image acquisition and reconstruction. Changing this input signal for precise alignments is more accurate and less costly than prior methods which rely on mechanical alignment of the x-ray tube.

Another object of the invention is to maintain the focal spot in its optimal location during the continued operation of the CT imaging system. A focal spot position feedback signal is produced and is input to the variable current power supply to produce an offsetting current in the deflection coil. This offsetting current moves the focal spot back to its optimal location if it drifts during system operation.

Yet another object of the invention is to implement focal spot wobbling. The x-ray tube focal spot may be intentionally shifted between two optimal focal spot locations during a scan or between scans. This is achieved by applying another input signal to the variable current power supply corresponding to the second optimal position and alternating between the two signals each time the focal spot is to be wobbled.

DESCRIPTION OF THE PREFERRED EMBODIMENT

Figure 1:
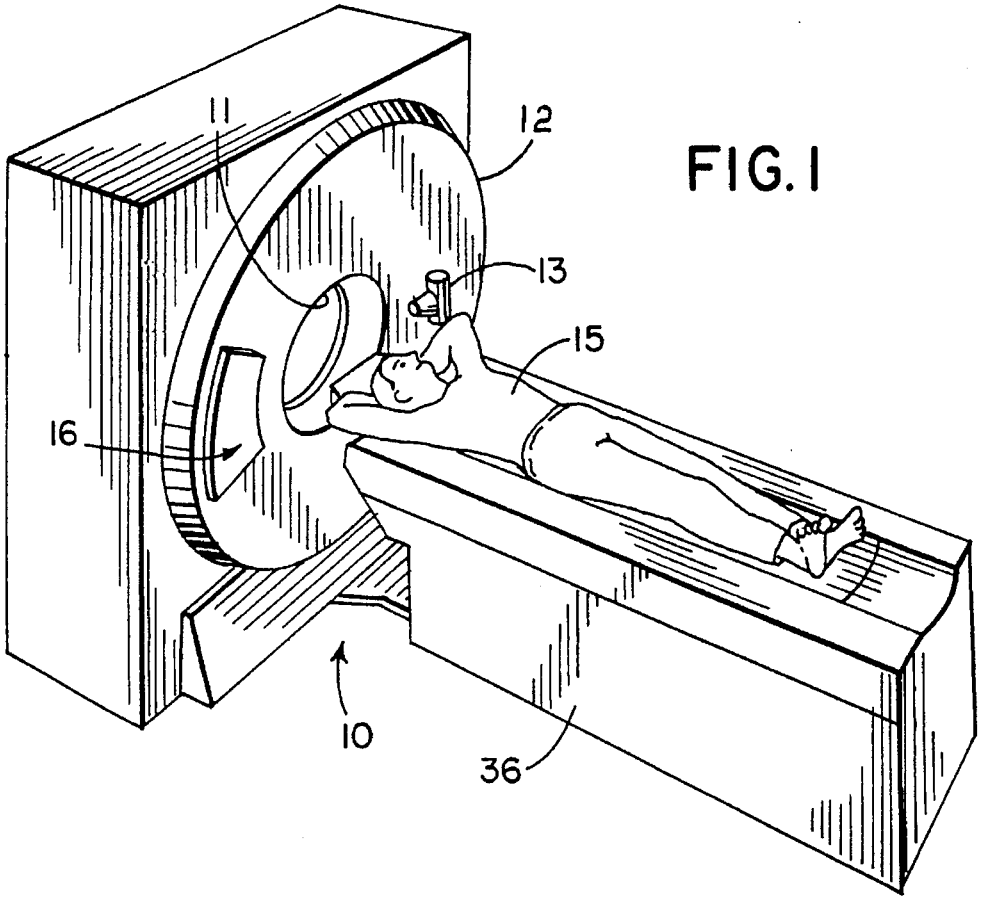
FIG. 1 is a pictorial view of a CT imaging system in which the present invention may be employed.
Figure 2:
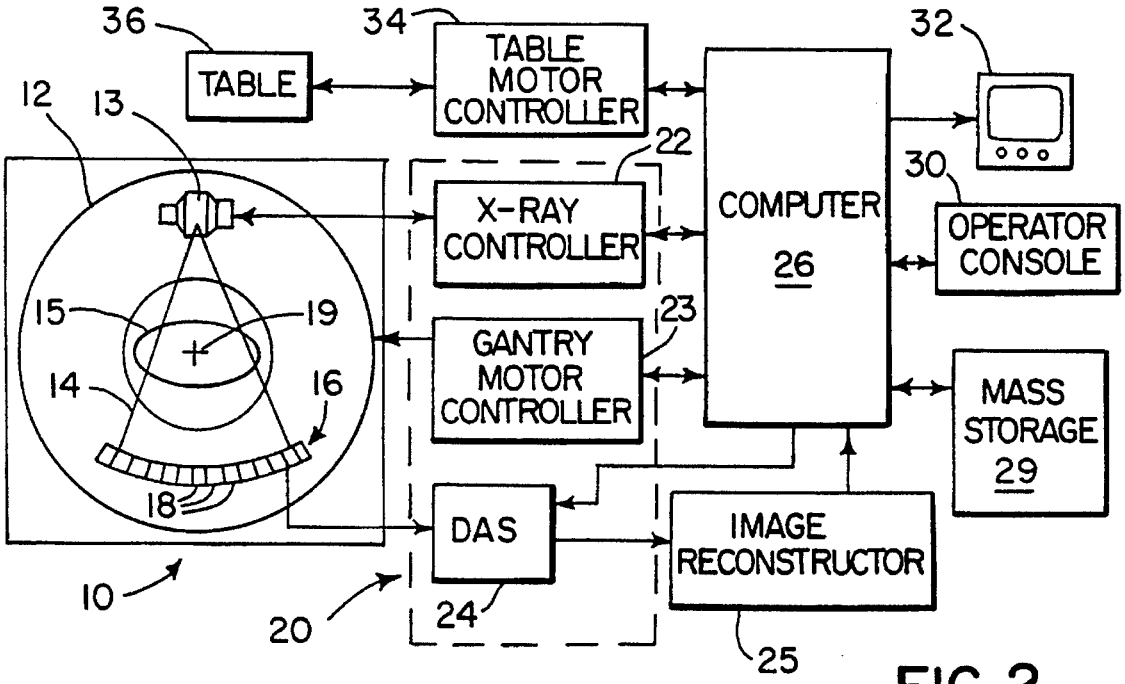
FIG. 2 is a block schematic diagram of the CT imaging system.

With initial reference to FIGS. 1 and 2, a computed tomography (CT) imaging system 10 includes a gantry 12 representative of a "third generation" CT scanner. Gantry 12 has a collimated x-ray tube 13 that projects a beam of x-rays 14 toward a detector array 16 on the opposite side of the gantry. The detector array 16 is formed by a number of detector elements 18 which together sense the projected x-rays that pass through a medical patient 15. Each detector element 18 produces an electrical signal that represents the intensity of an impinging x-ray beam and hence the attenuation of the beam as it passes through the patient. During a scan to acquire x-ray projection data, the gantry 12 and the components mounted thereon rotate about a center of rotation 19 located within the patient 15.

The rotation of the gantry and the operation of the x-ray tube 13 are governed by a control mechanism 20 of the CT system. The control mechanism 20 includes an x-ray controller 22 that provides power and timing signals to the x-ray tube 13 and a gantry motor controller 23 that controls the rotational speed and position of the gantry 12. A data acquisition system (DAS) 24 in the control mechanism 20 samples analog data from the detector elements 18 and converts the data to digital signals for subsequent processing. An image reconstructor 25, receives sampled and digitized x-ray data from the DAS 24 and performs high speed image reconstruction according to the method of the present invention. The reconstructed image is applied as an input to a computer 26 which stores the image in a mass storage device 29.

The computer 26 also receives commands and scanning parameters from an operator via console 30 that has a keyboard. An associated cathode ray tube display 32 allows the operator to observe the reconstructed image and other data from the computer 26. The operator supplied commands and parameters are used by the computer 26 to provide control signals and information to the DAS 24, the x-ray controller 22 and the gantry motor controller 23. In addition, computer 26 operates a table motor controller 34 which controls a motorized table 36 to position the patient 15 in the gantry 12.

Figure 3:
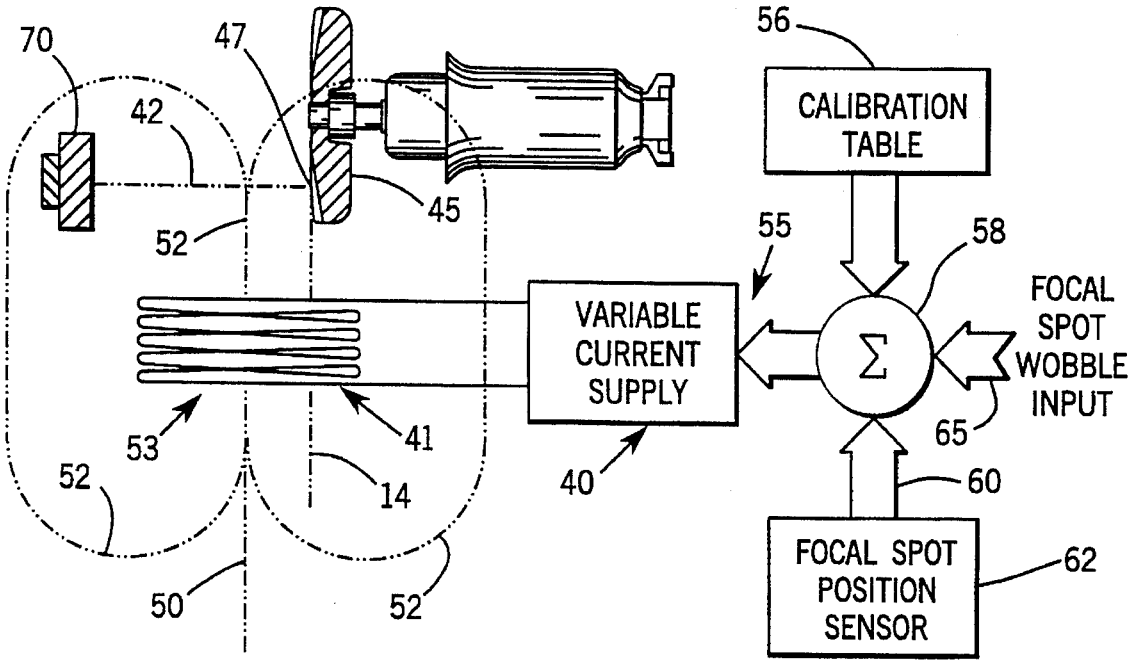
FIG. 3 is an electrical block diagram of a focal spot positioning system which forms part of the CT imaging system of FIG. 1.

Referring particularly to FIG. 3, the x-ray controller 22 includes a variable current power supply 40 which connects to a deflection coil 41. As will be explained in more detail below, the deflection coil 41 is mounted in the x-ray tube assembly 13 at a location near the path of an electron beam 42 produced in the x-ray tube 13 by a cathode assembly 43. This electron beam strikes the surface of a rotating anode 45, and a beam of x-rays 14 are produced. The location on the anode surface 45 where the electron beam strikes is the focal spot 47, and it is this location which must be precisely aligned and maintained.

The deflection coil 41 is wound as a solenoid and it is oriented with its central axis 50 substantially perpendicular to the path of the electron beam 42 and intersecting the mid-point of the path between the cathode 43 and anode 45. The magnetic flux produced by the coil 41 forms closed linkage paths in accordance with well known physical principles. One such set of flux linkages is indicated by dashed line 52. Although the magnetic field produced off the end of the solenoidal coil 41 is somewhat divergent, the geometrical relationship between the coil 41 and the electron beam 42 is chosen so as to develop a substantially uniform magnetic field substantially normal to the path of the electron beam 42. A force F equal to the cross product of the velocity V of the electron beam and the magnetic flux vector B($\overline{F}=\overline{V}\times\overline{B}$) acts on the electron beam 42 to deflect the electron beam 42 and move the focal spot 47. In FIG. 3, the direction of the movement is perpendicular to the plane of the paper and the deflection coil 41 is positioned such that the generated x-rays pass through a central opening 53 therein. In the preferred embodiment, the deflection coil 41 is constructed of 100 turns of #18 AWG copper wire and the variable current power supply 40 has a capacity of ±5 amperes at a voltage sufficient to regulate the current at the desired amount. When the x-ray tube 13 is operated at a voltage of 140 kv, the focal spot 47 may be moved up to 1.15 mm from the "straight path" impact location, and when operated at 80 kv, the focal spot 47 may be moved up to 1.5 mm. The direction of this movement is determined by the direction of current flow through the deflection coil 41, and hence the polarity of the input signal to the current supply 40.

The current produced by the variable current power supply 40 may be controlled to position the focal point 47 and achieve a number of objectives. First, during system calibration the focal spot 47 must be precisely aligned. To accomplish this, the x-ray tube 13 is first aligned mechanically to bring the focal spot 47 to within 0.25 mm of the desired location. Then a control signal of the proper polarity and magnitude is applied to a control input 55 on the current supply 40 to deflect the focal spot 47 to its final location. The value of this input voltage is stored in a calibration table 56 and, prior to each scan, this value is read and applied to the variable current supply 40 through a summing point 58. Since the amount of deflection is dependent on the x-ray tube operating voltage, a calibration value is stored for each focal spot in the table 56 for each system operating voltage. When the tube voltage parameter is set prior to each scan, the corresponding calibration value is read from the table 56 and used to establish the desired static operating position of the focal spot 47.

The control voltage applied to the input 55 of the variable current power supply 40 can also be used to correct for drifting of the focal spot location during a series of scans. As indicated above, such dynamic movement of the focal spot is due primarily to changes in dimensions caused by the heat which is produced at the tube anode 45 during a scan. This problem is addressed by providing a focal spot position feedback signal at input 60 on summing point 58. This feedback signal is preferably produced by a focal spot position sensor 62 disposed at the ends of the detector array 16, although it may also take the form of a table of values indicative of focal spot drift as a function of a parameter such as x-ray tube temperature. Regardless of the method used to sense focal spot drift, the position feedback signal at input 60 results in a current flow in the deflection coil 41 which moves the electron beam 42 to offset the drift. This correction current is adjusted before each scan and remains constant during the subsequent scan, or if a helical scan is being performed, it is adjusted before the scan and continuously changed during the scan.

The present invention may also be used to implement "focal spot wobbling". Dynamic focal spot wobbling is a technique for increasing the resolution of the reconstructed image by acquiring the successive views using two discrete x-ray focal spots. Preferably, the focal spot is switched, or "wobbled" between the two focal spots as successive views are acquired during the scan. This technique is described, for example, in U.S. Pat. No. 4,637,040 and it is achieved according to the present invention by adding a signal to a third input 65 of the summing point 58 and alternating the polarity of that signal to wobble the focal spot in the desired sequence. The focal spot wobble input signal results in a current through the deflection coil 41 that moves the focal spot in one direction one-half the desired wobble distance from its static location, and when the polarity of this input signal is switched between views, the focal spot is moved one-half the desired wobble distance in the other direction from the focal spot's static position. It is also possible to perform "static wobbling" in which the focal spot is moved between scans. After each focal spot change, another complete scan is acquired.

The focal spot wobble input signal is produced by the computer 26 which synchronizes the operation of the x-ray tube 13 and the gantry motion during each scan. The computer 26 directs the gantry motor controller 23 to position the x-ray tube 13 and detectors 18 for the next view, applies the proper focal spot wobble input signal to the variable current power supply 40, and signals the x-ray controller 22 to initiate the exposure for one view. This cycle is repeated for each view of the scan with the focal spot wobble input signal being toggled between its two values.

As shown in FIG. 3, the magnetic flux 52 produced by the deflection coil 41 links with the metallic elements that form the cathode assembly 43. As a result, any change in the magnetic properties of these elements will directly affect the magnetic flux 52 and indirectly affect the movement of the focal spot 47. It has been discovered that during the operation of the CT imaging system, the temperature of the cathode structure may range from 20° C. to 600° C. For many materials commonly used in the cathode assembly 43, such as nickel, this temperature range includes the Curie temperature of the material. The Curie temperature is a property of magnetic materials, and at the Curie temperature, ferromagnetic materials become paramagnetic and their effect on the magnetic flux 52 changes. The result is an undesirable increase in the deflection of the electron beam 42.

The solution to this problem is to construct the cathode assembly with materials that are not magnetic, or if magnetic, do not have a Curie temperature within the operating temperature range of the cathode assembly component. Materials which satisfy this requirement include: "Monel" (a commercially available corrosion resistant nickel/copper alloy); "TZM" (a commercially available molybdenum alloy); Aluminum; and Copper.

Figure 4:
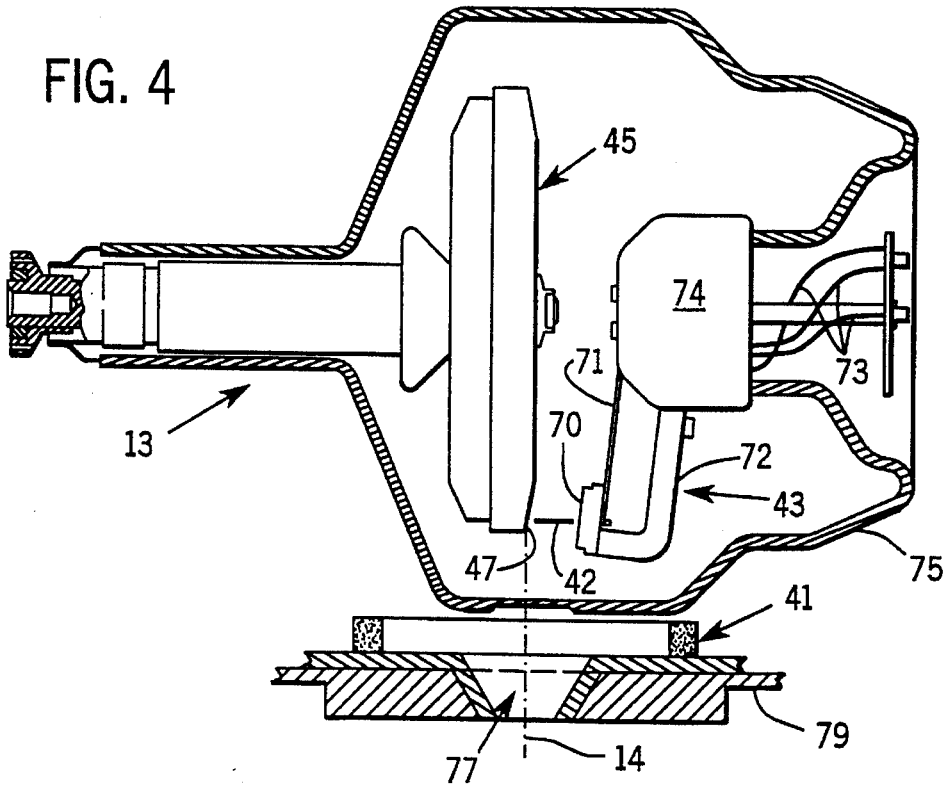
FIG. 4 is a partial elevation view of the x-ray tube employed in the CT imaging system of FIG. 1.

Referring particularly to FIG. 4, the cathode assembly 43 is comprised of a number of separate elements. These include a cathode cup 70 which supports the filament (not shown) and which serves as an electrostatic lens that focuses the electrons emitted from the heated filament. The cathode cup 70 is mounted on the end of a support arm 71, and a mask 72 encloses wiring 73 that extends from a central shell 74. In the preferred embodiment, the support arm 71, mask 72 and shell 74 are constructed from a nickel/copper alloy sold under the trademark "MONEL". The cathode cup 70 is constructed from TZM. The Curie temperature of the cathode elements are thus outside the operating temperature range of the cathode assembly.

Referring still to FIG. 4, the deflection coil 41 is mounted as close as possible to the glass envelope 75 of the x-ray tube 13 and it surrounds the aperture 77 in the surrounding casing 79 through which the x-rays 14 travel. The coil 41 has an outside diameter of 5.25 inches, and inside diameter of 4.50 inches and a thickness of 0.50 inches. It should be apparent that the electron beam 42 is close enough to the glass envelope 75 that it will lie almost entirely within the central part of the solenoidal field produced by the deflection coil 41. As a result, the magnetic field produced by the deflection coil 41 appears substantially uniform and substantially normal to the electron beam path 42.

It should be apparent to those skilled in the art that while the present invention is particularly applicable for x-ray tube assemblies used in CT scanners, the invention may be used to control the focal spot on x-ray tubes used in other x-ray systems.

We claim:

1. In an x-ray system having an x-ray tube that produces x-rays by generating an electron beam within an envelope at a cathode and directing the electron beam along a path which strikes the surface of an anode at a focal spot from which the x-rays emanate, the improvement comprising:

a deflection coil mounted adjacent to the electron beam for producing a magnetic field which is substantially uniform and substantially normal to the path of the electron beam when a current is applied to the deflection coil, wherein the magnetic field acts on the electron beam to change its path and thereby change the location of the focal spot on the anode;

a variable current power supply connected to the deflection coil for applying a current thereto which is controlled by an input signal;

means for applying an input signal to the variable current power supply which changes the location of the focal spot by a predetermined amount;

in which the means for applying an input signal includes calibration means for producing an input signal that aligns the focal spot at a predetermined static operating position; and the calibration means includes a calibration table that stores calibration values that indicate the input signal to be applied to the variable current power supply at a plurality of corresponding x-ray tube operating parameters.

2. The improvement as recited in claim 1 in which the tube operating parameters include a high voltage value applied between the cathode and anode.

3. In an x-ray system having an x-ray tube that produces x-rays by generating an electron beam within an envelope at a cathode and directing the electron beam along a path which strikes the surface of an anode at a focal spot from which the x-rays emanate, the improvement comprising:

a deflection coil mounted adjacent to the electron beam for producing a magnetic field which is substantially uniform and substantially normal to the path of the electron beam when a current is applied to the deflection coil, wherein the magnetic field acts on the electron beam to change its path and thereby change the location of the focal spot on the anode;

a variable current power supply connected to the deflection coil for applying a current thereto which is controlled by an input signal;

means for applying an input signal to the variable current power supply which changes the location of the focal spot by a predetermined amount; and in which the x-ray system is a CT system that acquires a series of views during a scan in which the x-ray tube moves around an object being imaged, and the means for applying an input signal includes means for producing a focal spot wobble input signal for operating the variable current power supply to move the focal spot alternately between two spaced locations on the anode in synchronism with the acquisition of views during a scan.

4. In an x-ray system having an x-ray tube that produces x-rays by generating an electron beam within an envelope at a cathode and directing the electron beam along a path which strikes the surface of an anode at a focal spot from which the x-rays emanate, the improvement comprising:

a deflection coil mounted adjacent to the electron beam for producing a magnetic field which is substantially uniform and substantially normal to the path of the electron beam when a current is applied to the deflection coil, wherein the magnetic field acts on the electron beam to change its path and thereby change the location of the focal spot on the anode;

a variable current power Supply connected to the deflection coil for applying a current thereto which is controlled by an input signal; and means for applying an input signal to the variable current power supply which changes the location of the focal spot by a predetermined amount; and in which the magnetic field produced by the deflection coil couples with elements of a cathode assembly that supports the cathode, and said elements are formed from materials which do not have a Curie temperature within the operating temperature range of the cathode assembly elements.

* * * * *